US005718093A

United States Patent [19]

Tanaka

[11] Patent Number: 5,718,093

[45] Date of Patent: Feb. 17, 1998

[54] FLOOR PANEL JOINT STRUCTURE AND METHOD OF MAKING A WOODEN BUILDING WITH THE SAME

[75] Inventor: Masakatsu Tanaka, Osaka, Japan

[73] Assignee: Tanaka Masakatsu Design Office Co., Ltd., Osaka, Japan

[21] Appl. No.: 619,283

[22] Filed: Mar. 19, 1996

[30] Foreign Application Priority Data

Mar. 20, 1995 [JP] Japan ..... 7-087324

[51] Int. Cl.[6] ..... E04D 1/36

[52] U.S. Cl. ..... 52/471; 52/802.1; 52/470; 52/747.1

[58] Field of Search ..... 52/470, 471, 469, 52/293.3, 292, 299, 90.1, 93.1, 745.19, 747.1, 783.1, 783.18, 784.16, 786.13, 790.1, 793.1, 793.11, 800.11, 799.11, 802.1, 802.11; 403/339, 258, 260, 256

[56] References Cited

U.S. PATENT DOCUMENTS

| | | | |
|---|---|---|---|
| 1,499,874 | 7/1924 | Reinhardt | 52/802.1 X |
| 1,514,398 | 11/1924 | Steinbrenner | 52/293.3 X |
| 1,778,443 | 10/1930 | Zellmer | 52/802.1 X |
| 2,297,072 | 9/1942 | Raggio | 52/802.1 X |
| 2,620,521 | 12/1952 | Fleet | 52/802.1 X |
| 2,664,596 | 1/1954 | Greig | 52/802.1 X |
| 3,665,668 | 5/1972 | Maddan, Jr. | 52/783.1 X |
| 3,925,938 | 12/1975 | Molen | 52/90.1 X |
| 4,578,909 | 4/1986 | Henley et al. | 52/293.3 X |
| 4,712,238 | 12/1987 | Trickel | 52/470 X |
| 5,052,164 | 10/1991 | Sandow | 52/786.13 |
| 5,390,455 | 2/1995 | Antolini | 52/299 |

FOREIGN PATENT DOCUMENTS

| | | | |
|---|---|---|---|
| 1004161 | 3/1952 | France | 52/90.1 |
| 1538761 | 9/1968 | France | 52/783.1 |
| 3-202521 | 9/1991 | Japan . | |
| 3-233041 | 10/1991 | Japan . | |
| 6-129004 | 5/1994 | Japan . | |
| 6-136869 | 5/1994 | Japan | 52/292 |
| 1185247 | 3/1970 | United Kingdom | 52/783.1 |

*Primary Examiner*—Creighton Smith

*Attorney, Agent, or Firm*—Jordan and Hamburg

[57] ABSTRACT

A floor panel joint structure and a method of constructing a wooden building with the same are provided. The method comprises mounting floor panels on the foundation, and, joining a group of structural units to the foundation to produce a first floor structure. This is followed by mounting on the structural units at the first floor another group of structural units having a second floor structure made of floor panels joined to each other by panel joiners. The second floor structure are joined to top beams of the structural units at the first floor by through bolts which extend vertically across the floor panel, panel joiner, and beam. A roof structure is fabricated by joining roof panels to purlins. The purlin has a rib provided on a lower side thereof for connecting to the beams by a length of plywood boards. Accordingly, the installation of the floor and roof structures is simplified and its physical strength will be increased.

3 Claims, 7 Drawing Sheets

FIG. 6

| STRENGTH OF COMMON LUMBER (MATERIALS : NEEDLE-LEAF TREES SUCH AS CYPRESS AND PINE) | | | STRENGTH OF PLYWOOD LAMINATED MATERIAL USED IN STRUCTURAL ASSEMBLY OF THE INVENTION (MATERIALS : BROAD-LEAF TREES SUCH AS LAUAN AND BEECH) | | |
|---|---|---|---|---|---|
| RESISTANCE TO LONG-TERM LOAD kg/cm² | | | RESISTANCE TO LONG-TERM LOAD kg/cm² | | |
| COMPRESSION | TENSION/ BENDING | SHEAR | COMPRESSION | TENSION/ BENDING | SHEAR |
| 80 | 90 | 7 | 225 | 225 | 15 |

FLOOR PANEL JOINT STRUCTURE AND METHOD OF MAKING A WOODEN BUILDING WITH THE SAME

BACKGROUND OF THE INVENTION

The present invention relates to a floor panel joint structure and a method of making a wooden building with the same, and particularly, to a method of constructing a wooden building with structural units and a joint structure between floor panels used in the method.

For ease of a constructing process for making buildings, unit type construction methods are known in which a plurality of structural units of an identical shape consisting of a framework of structural members such as pillars, beams, and joists are prefabricated at a factory and assembled at a site of construction by joining to each other vertically and horizontally. Such a unit type construction method comprises a small number of steps because its assembly process at the location of construction is simple and labor saving, thus decreasing the overall cost.

The conventional unit type construction methods are only advantageous for labor saving in assembling frameworks at the location of construction while floor and roof sections have to be constructed by a traditional manner using joists and rafters. This results in little simplification of the process of constructing the floor and roof sections.

SUMMARY OF THE INVENTION

It is an object of the present invention, to solve the foregoing problem, by providing a method of making wooden buildings in which floor and roof structures are constructed in a simple manner which results in a higher physical strength than that of conventional floor and roof frameworks.

According to a floor panel joint structure of the present invention, a panel joiner is fitted into between two surface boards of each floor panel. The panel joiners with their respective floor panels are placed on and joined to top beams of structural units by through bolts. This allows the load at the joint to be not concentrated at one point but divided for dissipation, thus increasing the joining strength of the floor panel.

According to a method of constructing a wooden building, a floor structure is built by mounting panels made of plywood boards on panel supports of a foundation, assembling a plurality of prefabricated structural units on a framework of the building, and producing a roof structure with plywood boards, a ridge, and purlins, each purlin having a rib provided on a lower side thereof. Hence, the floor structure eliminates the need of traditional structural members such as joists and braces, and the roof structure eliminates the need of traditional structural members such as rafters, whereby the installation of the floor and roof structures is simplified. This results in reduction of the number of steps not only in assembling the structural units to a framework but also in installing the floor and roof structures. Also, the floor and roof structures constructed by the method of the present invention are higher in the physical strength than any conventional floor and roof frameworks.

According to another method of the present invention, a group of second-floor structural units having a floor structure made with panel joiners, each joiner fitted into between two surface boards of each floor panel, are placed on and joined to top beams of the structural units assembled by the method of claim 2 by means of bolts, each extending across the floor panel, panel joiner, and top beam. Hence, any load at the joint is not concentrated but dispersed and the joining strength of the floor panel at the joint will be increased.

BRIEF DESCRIPTION OF THE DRAWINGS

FIG. 6 is a diagram showing comparison in the strength between the plywood laminated material used as a pillar in the method of the present invention and common lumber material;

DETAILED DESCRIPTION OF THE EMBODIMENTS

Figure 1:
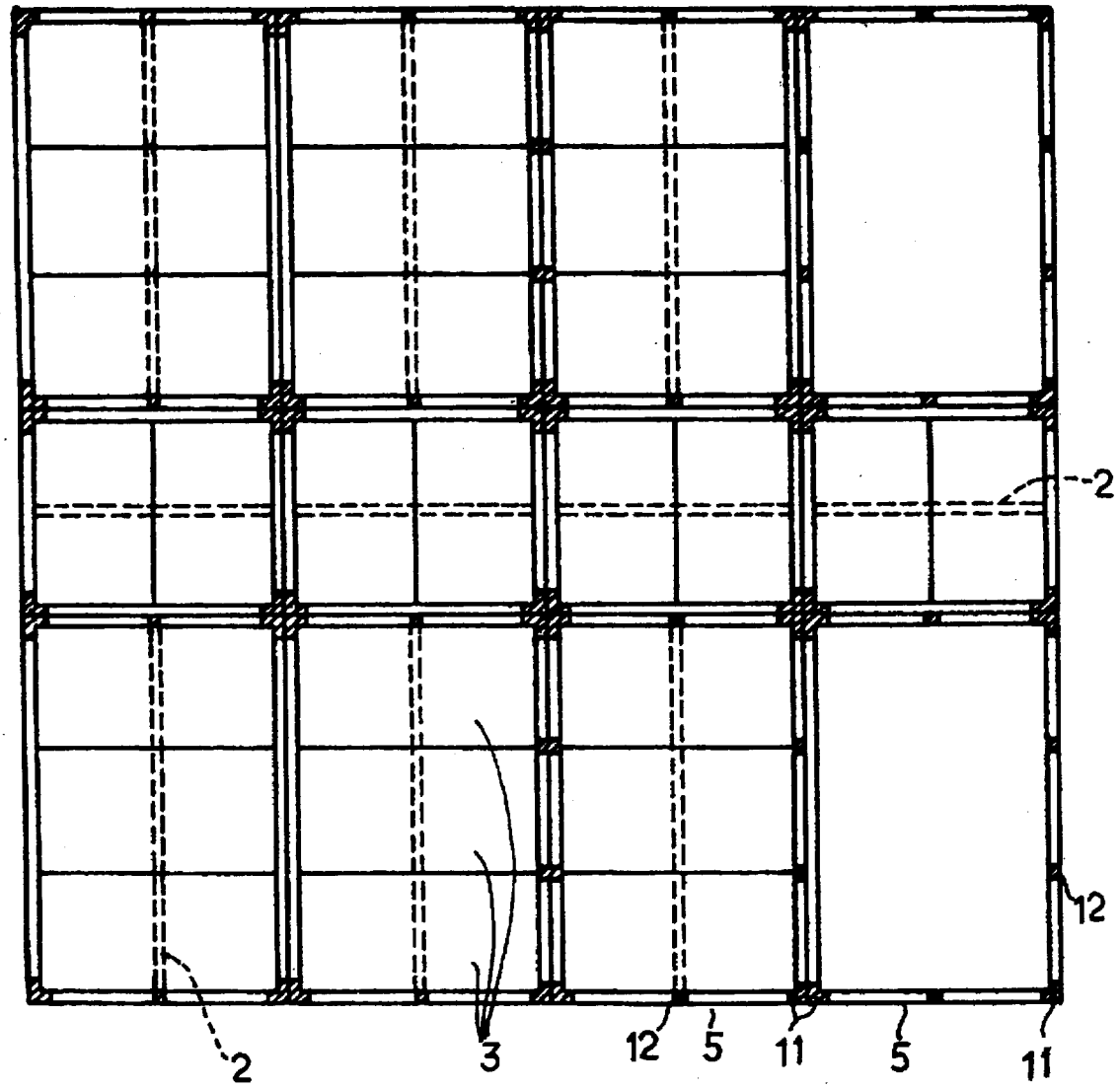
FIG. 1 is a plan view showing an arrangement of pillars, intermediate pillars, and sills and an allocation of floor panels in a building constructed by a method according to the present Invention.
Figure 2:
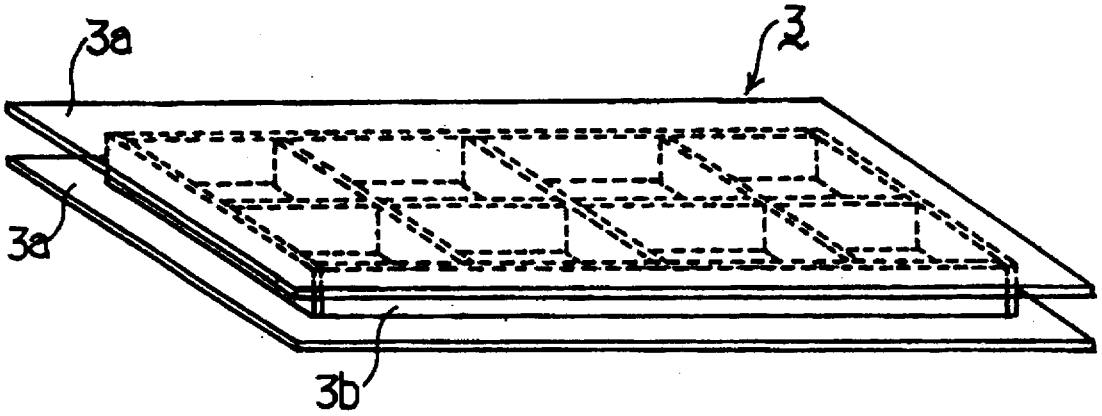
FIG. 2 is a perspective view showing a fundamental form of the floor panel used in the method of the present invention.
Figure 3:
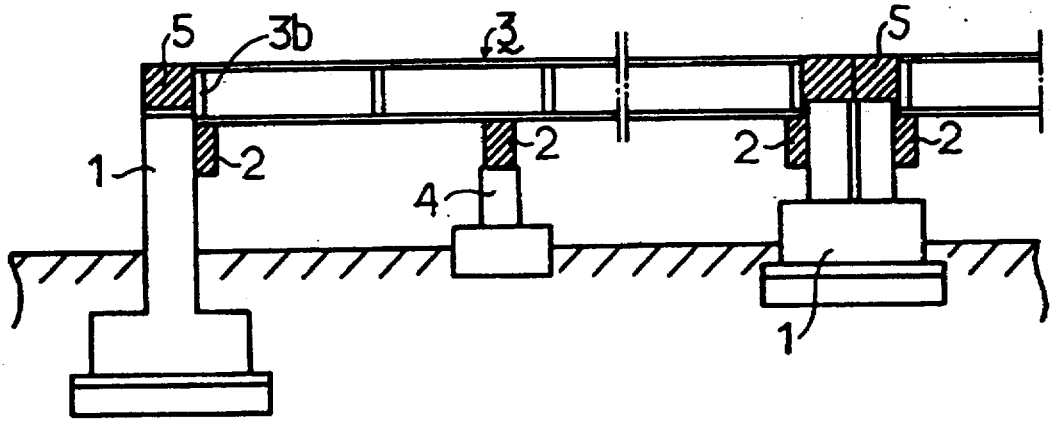
FIG. 3 is a side view showing installation of the floor panels on the foundation.

Embodiments of the present invention will be described referring to the accompanying drawings. FIG. 1 is a plan view showing an arrangement of pillars, intermediate pillars, and sills and an allocation of floor panels in a building constructed by a method of the present invention. FIG. 2 is a perspective view showing a fundamental shape of the floor panel used in the method of the present invention. FIG. 3 is a side view of the floor panels being installed on the foundation. A foundation 1 is preferably a steel-reinforced concrete base for ensuring optimum structural strength. Floor panels 3 form a floor framework are supported by panel supports 2 mounted inside the building. The panel supports 2 may be arranged integral with the foundation 1 or installed later at the site.

The floor panel 3 has a construction in which a plurality of cross members 3*b* are framed between two surface boards 3*a* (FIG. 2). The surface boards 3*a* and cross members 3*b* are made of plywood. The number of the cross members 3*b* and the thickness and size of the surface boards 3*a* and cross members 3*b* are varied depending on the requirement of strength. The floor panels 3 are mounted on the panel supports 2 forming the floor framework. The floor framework is increased in strength by locating the cross members 3*b* at the joints between the floor panels 3 and the panel supports 2 (FIG. 3). As the floor panels 3 are laid throughout a floor space (FIG. 1), the floor framework is completed with the panel supports 2 joined to the floor panels 3. Also, each of the floor panels 3 is sustained its center by a combination one of the panel supports 2 and a post 4. The panel supports 3 are mounted so that sills 5 and the floor panels 3 are identical in the height of installation. In particular, the floor panels 3 are utilized as components of the wall framework and roof section with their surface boards 3*a* and cross members 3*b* being trimmed to appropriate sizes for applications.

Figure 4:
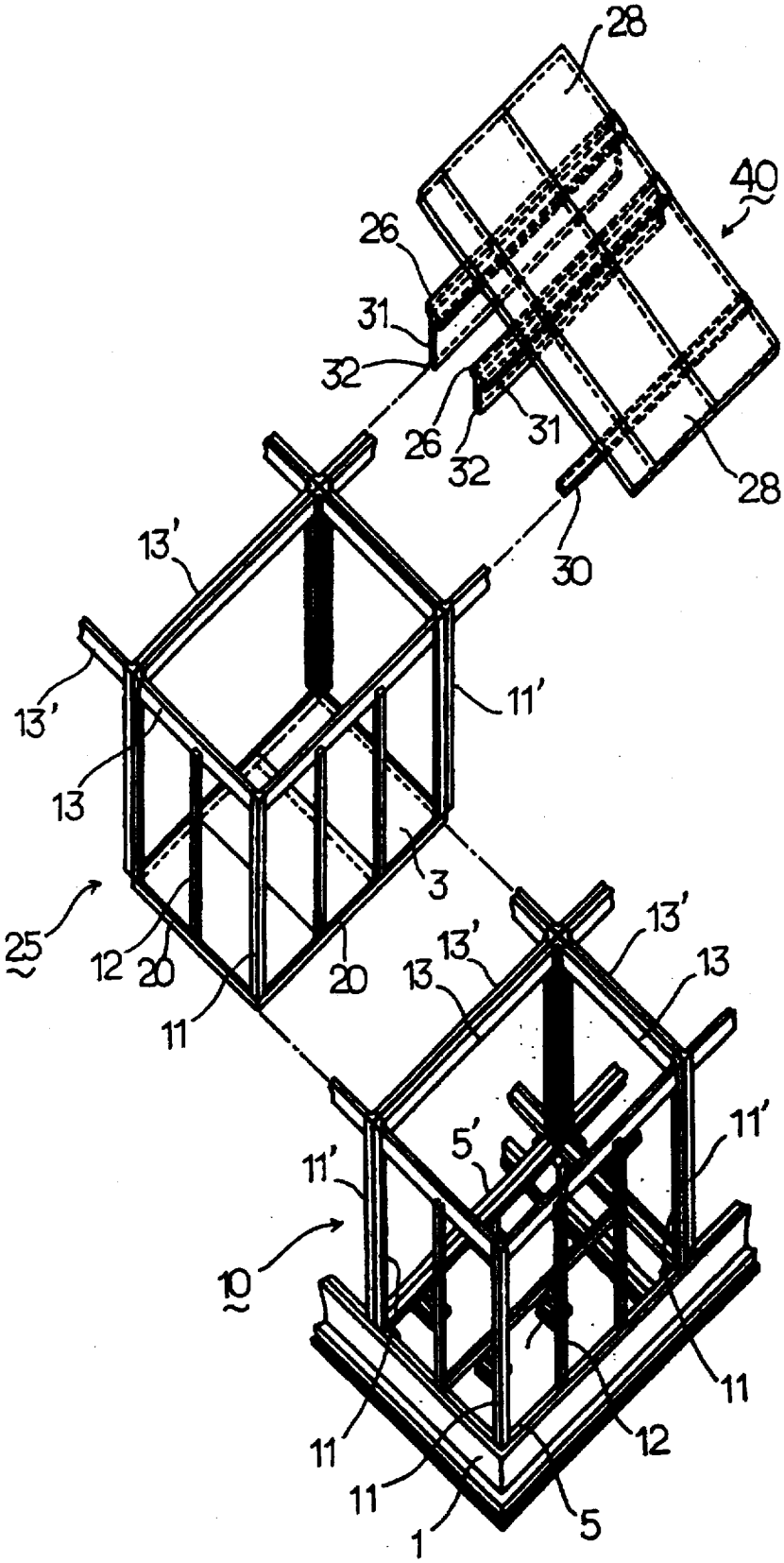
FIG. 4 is a perspective view of an arrangement of structural units used in the method of the present invention, where walls are not shown.

A structural unit will now be described. FIG. 4 is a perspective view of an arrangement of structural units in a roof structure according to the present invention, where walls are not illustrated. A structural unit 10 having a framework and walls of the building comprises the sills 5, a corner pillar 11, intermediate posts 12, and beams 13 which have been assembled together as well as the walls at a location or factory other than a site of construction. It is understood that the structural unit 10 is not limited in dimensions but should be sized and shaped to have a desired physical strength and to be easily transported from the factory to a site of installation. A number of the structural units 10, prefabricated at the factory, are joined to each other horizontally or vertically and crowned with a roof structure 40 to yield a building. As shown in FIG. 4, the structural unit 10 is connected to sills 5', pillars 11' and beams 13' of other structure units.

For producing a framework and a wall structure, the structural units 10 are placed in an array, joined to each other, and anchored with their sills 5 to a foundation 1 using anchor bolts or the like. Each structural unit 10 with walls is transported to the site of installation. In case that the structural unit 10 has an intricate shape or design, it may be transported in its skeleton form and then accompanied with walls of plywood boards at the site of installation.

Figure 5:
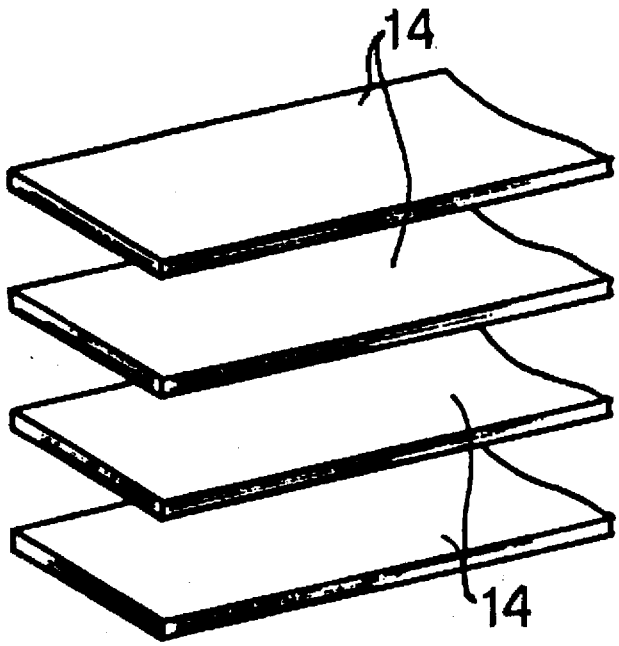
FIGS. 5(*a*) and 5(*b*) are a perspective exploded view and a perspective view of a plywood laminated material respectively.
Figure 5:
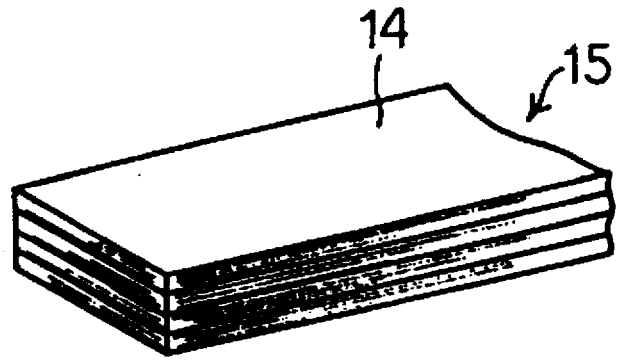

A plywood laminated material which is a member of a structural member such as a pillar, sill, or beam used in the method of the present invent will now be explained. FIG. 5(*a*) is a perspective exploded view showing the plywood laminated material and FIG. 5(*b*) is a perspective view of the same. FIG. 6 is a diagram showing a comparison in the strength between the plywood laminated material used in the method of the present invention and common lumber material. The pillar 11, posts 12, sills 5, and beams 13 of the structural unit 10 are made of the plywood laminated material 15 which comprises a plurality of sheet plywood boards 14 bonded one over the other. The structural unit 10 is thus prefabricated at a lower cost using the plywood laminated materials 15 rather than common lumber or known glue laminated timber or laminas. More specifically, the plywood laminated material 15 comprises four of the plywood boards 14 of 5-ply type and 18 mm thickness. The material of the plywood board 14 is broad-leaf trees which is as high as desirable in toughness and strength. It is found that when the plywood laminated material 15 has been fabricated satisfying the above requirements, its strength in compression and bending is about 2.5 times higher than traditional plywood materials (using needle-leaf trees) and its shear strength is substantially 2 times higher (FIG. 6). The plywood laminated material 15 itself has a higher strength suited for use as a structural member such as a pillar.

Figure 7:
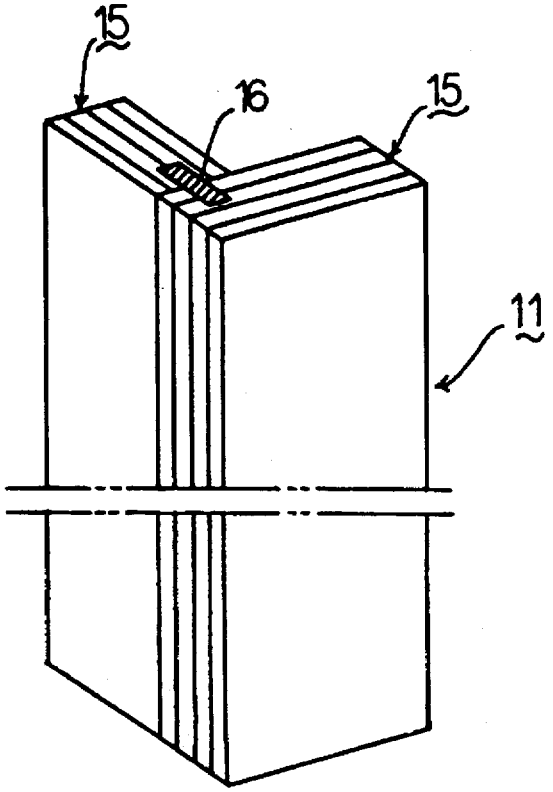
FIG. 7 is a perspective view showing the pillar installed at each corner of the building.

The pillar 11 installed at every corner of the structural unit 10 is explained below. FIG. 7 is a perspective view showing the pillar 11 at a corner of the structural unit 10. The pillar 11 at the corner of the structural unit 10 is a structural assembly made of the two plywood laminated materials 15 bonded to each other with their laminating directions being perpendicular to each other, having an L shape in cross section. The pillar 11 of the two plywood laminated materials 15 bonded to each other in the L shape is higher in in strength to compression, bending and shear than the single plywood laminated material 15 of a pillar form. The pillar 11 is also increased in the contact area to the sills 5 thus giving a higher joining strength with the sills 5 and causing the building to have a higher degree of earth-quake resistance. In addition, a joint supplement 16 of a narrow strip shape is embedded at a right angle to and in a substantially center region of the interface between the two plywood laminated materials 15 of the pillar 11. The joint supplement 16 is tightly joined to both the plywood laminated materials 15 so that the bonding strength at the interface is increased against peeling off or separation. The post 12 is made of a single plywood laminated material 15.

Figure 8:
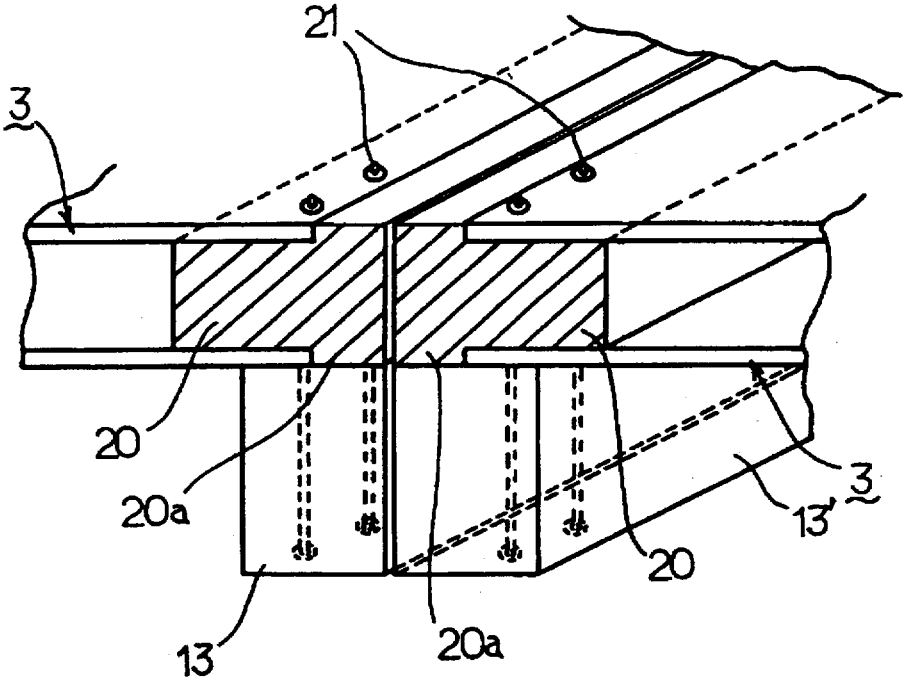
FIG. 8 is a cross-sectional view showing a joint between two floor panels at the second floor.

A floor structure of the second floor will now be described referring to FIGS. 4 and 8. FIG. 8 is a cross-sectional view showing a joint of the floor panels 3 and the beams 13 at the second floor,. The floor, structure of the second floor like the first floor, is composed of the floor panels 3. The floor panels 3 at the second floor are joined to each other by means of panel joiners 20. The panel joiner 20 comprises a body having a thickness equal to the distance between the two, upper and lower, surface boards 3*a* of the floor panel 3, and an extension 20*a* having a thickness equal to the thickness of the floor panel 3 from the upper to the lower surface board 3*a* (FIG. 8). The panel joiner 20 extends throughout the length of the sill 5 of the structural unit 10 and is fitted into an edge of the floor panel 3 so as to be integral with the floor panel 3, thus being a member of the floor structure of the second floor (FIG. 4).

At the second floor, the structural units 10 are provided without the sills 5 to form second-floor structural units 25. The structural unit 25 is placed on and joined to the upper beams 13 of the structure unit 10 by tightening bolts 21 extending vertically through the floor panel 3, panel joiner 20, and beam 13 (FIG. 8). As the floor panels 3 of the second floor are securely joined by the panel joiners 20 to the beams 13 of the first floor, the joint between two, upper and lower, structural units is increased in strength. This is followed by joining to another structural unit 25 horizontally, thus producing the floor structure of the second floor along with a wall structure.

Figure 9:
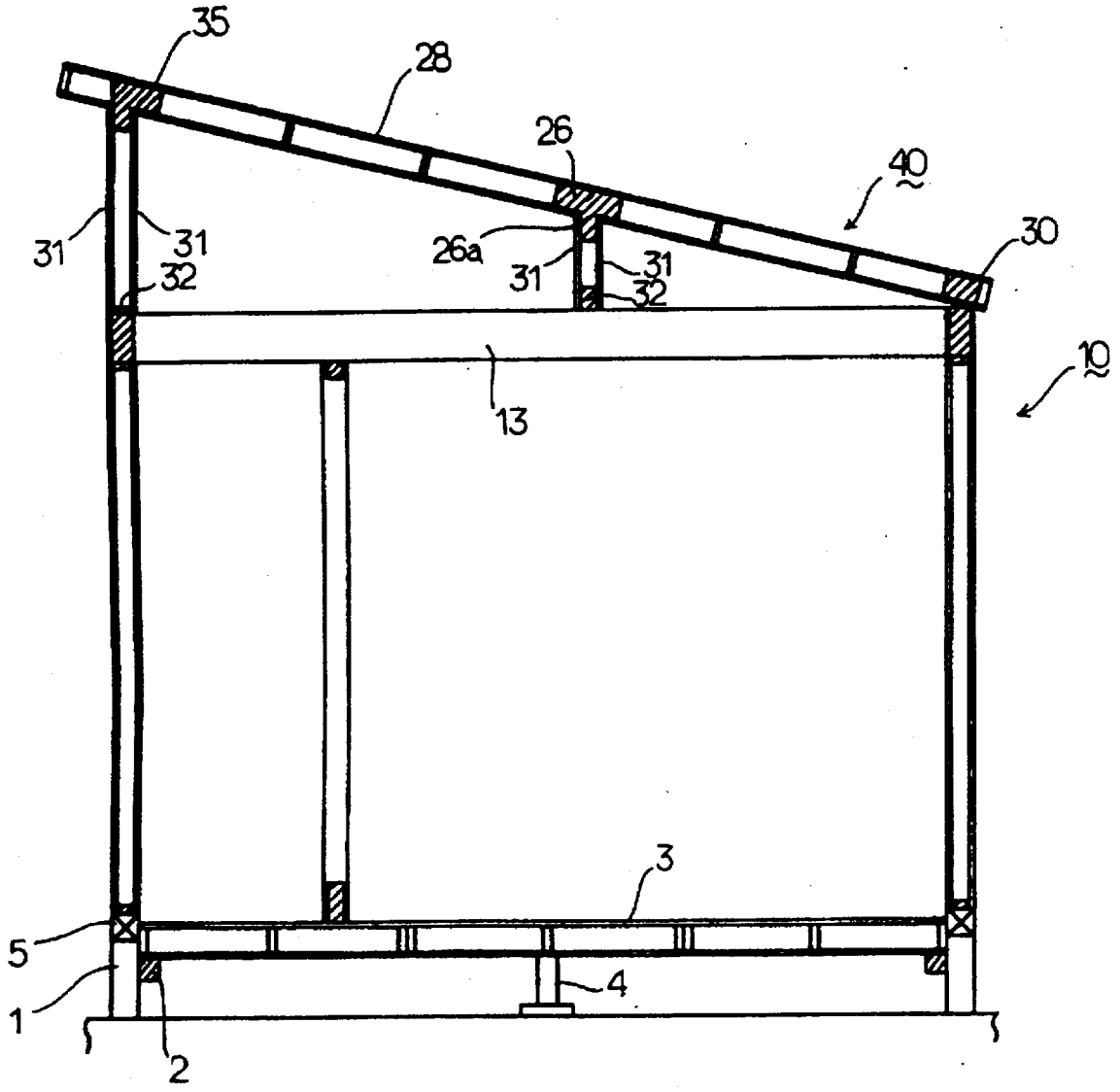
FIG. 9 is a side cross-sectional view showing a single-story house constructed by the method of the present invention.

The installation of roof structure 40 will now be described referring to FIGS. 4 and 9. FIG. 9 is a side cross-sectional view showing a part of a single-story house constructed by the method of the present invention. The roof structure 40 comprises purlins 26 extending between both ends, a ridge beam (not shown), and roof panels 28, which are sized modifications of the floor panels 3, installed on the top beams 13 of the structural units 10 (or 25 in a two-story house). The purlin 26 has a rib 26*a* provided on a lower side thereof. The roof panels 28 are fitted from both side on and joined by nails or the like to the purlin 26 (FIG. 9) There are joint members 30 mounted in the roof panels 28 where the beams 13 are abutted. The joint members 30 are joined to the beams 13 with through bolts (not shown). Each joint between the joint member 30 and the beam 13 is reinforced at the interior by a roof panel retainer (not shown) made of a plywood board.

The rib 26*a* of the purlin 26 is supported by two plywood boards 31 of which lower ends are joined to the top beams 13 of the structural units 10 (25) to hold the purlin 26 and the roof panels 28 (FIG. 9). Accordingly, as the weight of the roof structure is loaded to not only the wall structure but also the plywood boards 31, the roof structure 40 will be increased in physical strength. A purlin 35 is arranged in an inverted V shape equivalent to a half size of the purlin 26 and is provided on the top of the beam 13 of the structural unit 10 (25) at the ridge end of the roof structure 40 for ease of joining any two adjacent structural units 10 (25) to each other.

In general, the structural members used in the method of the present invention are prefabricated at factory and transported to a site of installation, thus eliminating any extra sizing process at the site. The installation of the structural members at the site is simply carried by mounting the floor panels 3 on the sill 5, assembling the structural units 10 and 25, and mounting the roof panels 28 and their relevant members. The method of the present invention allows a building to be constructed with the structural members made of plywood boards. Also, the structural members including the panels are standardized in size and shape for ease of mass production, hence decreasing their prices. Accordingly, the overall cost of the building will be minimized. The present invention is not limited to the embodiment described and various modifications are possible. For example, the size of the panel joiner 20 and the shape of its extension 20*a* are not limited to those of the embodiment which match with the thickness of the floor panel 3 and the distance between the two surface boards 3*a* of the floor panel 3 respectively but may be tailored to other appropriate dimensions. If the two beams 13 of the adjacent structural units 10 or 25 are not identical in the height, the extensions 20*a* of the two panel joiners 20 are so differentiated in size from each other that their floor panels 3 are joined flush with each other.

What is claimed is:

1. A joint structure supporting a floor panel on a beam, the floor panel having an upper and a lower surface board interconnected by cross members sandwiched therebetween, the upper and lower surface boards defining a gap therebetween along at least one edge of the floor panel, the joint structure comprising:

a panel joiner having a first portion having a thickness substantially equal to a distance between the upper and lower surface boards of the floor panel corresponding to a width of said gap and a second portion forming an extension of said first portion, the second portion having a thickness substantially equal to a thickness of said floor panel and forming steps on opposing sides of said panel joiner substantially equal to thicknesses of the upper and lower surface boards;

said first portion of said panel joiner being fitted between the upper and lower surface boards of the floor panel;

said panel joiner and a lower surface of a portion of said lower surface board abutting said first portion of said panel joiner being disposed on said beam; and through bolts extending vertically through the floor panel, the first portion of said panel joiner, and said beam joining together said floor panel, said panel joiner and said beam.

2. A method of constructing a wooden building comprising the steps of:

(a) mounting panels on panel support members fixed horizontally to a foundation, the panels having an upper and a lower surface board interconnected by cross members sandwiched therebetween;

(b) mounting on the foundation a group of structural units, each of said structural units comprising a framework of sills, pillars, and upper beams bridging between the pillars; and (c) mounting the panels on purlins, each purlin having a rib provided on a lower side thereof, and joining the ribs of the purlins to the upper beams of the structural units using blocks of plywood board to produce a roof structure.

3. A method of constructing a wooden building having at least a first story and a second story, comprising the steps of:

(a) mounting panels on panel support members fixed horizontally to a foundation, the panels having an upper and a lower surface board interconnected by cross members sandwiched therebetween;

(b) mounting on the foundation a group of first story structural units, each of said structural units comprising a framework of sills, pillars, and upper beams bridging between the pillars;

(c) producing a floor structure of the second story using panel joiners, each of said panel joiners having a first portion with a thickness substantially equal to a distance between the upper and lower surface boards of said panels, said panel joiners having a second portion forming an extension of said first portion, the second portion having a thickness substantially equal to a thickness of said panels and forming steps on opposing sides of said panel joiners substantially equal to thicknesses of the upper and lower surface boards, said floor structure being produced by:

fixing between the upper and lower surface boards of the panels, along edges of said panels, said first portions of said panel joiners; and disposing said edges of said panels and said panel joiners on said upper beams of said first story structural units mounted on said foundation;

disposing a group of second story structural units above the upper beams of the first story structural units mounted to the foundation, each of said second story structural units comprising a framework of sills, pillars, and upper beams bridging between the pillars, and fastening said sills of said second story structural units together with the floor structure of the second story and said upper beams of said first story structural units mounted to said foundation using tightening bolts extending vertically through the panels of the floor structure of the second story, the panel joiners, and the upper beams of the first story structural units so that the second story structural units are joined to the first story structural units; and (d) mounting the panels on purlins, each purlin having a rib provided on a lower side thereof, and joining the ribs of the purlins to the upper beams of the second story structural units by blocks of plywood board to produce a roof structure.

* * * * *